US009410378B2

(12) United States Patent
Shao et al.

(10) Patent No.: US 9,410,378 B2
(45) Date of Patent: Aug. 9, 2016

(54) TRICONE ROCK BIT FOR HORIZONTAL WELLS AND HARD FORMATION WELLS

(71) Applicant: KINGDREAM PUBLIC LTD. CO., Wuhan, Hubei (CN)

(72) Inventors: Zengyuan Shao, Hubei (CN); Bin Pu, Hubei (CN); Xiaobing Fan, Hubei (CN)

(73) Assignee: KINGDREAM PUBLIC LTD. CO., Wuhan, Hubel (CN)

( * ) Notice: Subject to any disclaimer, the term of this patent is extended or adjusted under 35 U.S.C. 154(b) by 305 days.

(21) Appl. No.: 14/149,188

(22) Filed: Jan. 7, 2014

(65) Prior Publication Data

US 2014/0116787 A1 May 1, 2014

Related U.S. Application Data

(63) Continuation of application No. PCT/CN2011/080272, filed on Sep. 28, 2011.

(51) Int. Cl.

| | |
|---|---|
| ***E21B 10/16*** | (2006.01) |
| ***E21B 10/08*** | (2006.01) |
| ***E21B 10/18*** | (2006.01) |
| ***E21B 17/10*** | (2006.01) |

(52) U.S. Cl.

CPC ..... *E21B 10/16* (2013.01); *E21B 10/08* (2013.01); *E21B 10/18* (2013.01); *E21B 17/1092* (2013.01)

(58) Field of Classification Search

CPC ..... E21B 10/08; E21B 10/16; E21B 17/1092; E21B 10/18

See application file for complete search history.

(56) References Cited

U.S. PATENT DOCUMENTS

| | | | | |
|---|---|---|---|---|
| 6,227,314 | B1 | 5/2001 | Zadrapa et al. | |
| 6,446,739 | B1 | 9/2002 | Richman et al. | |
| 2010/0032215 | A1* | 2/2010 | Shao | E21B 17/1092 175/336 |

FOREIGN PATENT DOCUMENTS

| | | | |
|---|---|---|---|
| CN | 1648403 | A | 8/2005 |
| CN | 101382045 | A | 3/2009 |
| CN | 101806195 | A | 8/2010 |
| CN | 201802311 | U | 4/2011 |

OTHER PUBLICATIONS

State Intellectual Property Office of the P. R. China (ISA/CN), "International Search Report", China, Mar. 22, 2012.

* cited by examiner

*Primary Examiner* — Yong-Suk (Philip) Ro

(74) *Attorney, Agent, or Firm* — Tim Tingkang Xia, Esq.; Locke Lord LLP

(57) ABSTRACT

A tricone rock bit for horizontal wells and hard formation wells includes three head sections and three cones arranged at the lower ends of the head sections, where the supper parts of the three head sections are connected together to form one integrated drill bit body; jet nozzle bosses are arranged between the head sections on the drill bit body; jet nozzles are mounted in nozzle holes of the jet nozzle bosses; gauge cutting elements are arranged on the top rear of the OD of the head sections, forming a gauge surface on the top of the head sections; the front face of the head sections is a ruled surface, inclining backwards at an angle α, and inclining outwards at an angle β. The tricone rock bit has low lateral vibrations, high stability, good effects of bottom hole cleaning and cutting element cooling, long service life and high penetration rate.

15 Claims, 4 Drawing Sheets

TRICONE ROCK BIT FOR HORIZONTAL WELLS AND HARD FORMATION WELLS

CROSS-REFERENCE TO RELATED APPLICATION

This application is a continuation application of International Patent Application No. PCT/CN2011/080272, filed Sep. 28, 2011, entitled "TRICONE ROCK BIT FOR HORIZONTAL WELLS AND HARD FORMATION WELLS," by Zengyuan SHAO et al., which is hereby incorporated herein in its entirety by reference.

FIELD OF THE INVENTION

The present invention relates generally to the field of geological drilling and oil drilling, and more particularly to a tricone rock bit for horizontal wells and hard formation wells.

BACKGROUND OF THE INVENTION

The existing tricone rock bit usually includes a bit body with three head sections, a cone is rotatably mounted on bearing shaft inclined at lower ends of the head sections, the cone having steel cutting elements or cemented carbide inserts, and drilling fluid is pumped into a drill fluid course from a drill string, and then is discharged out of three nozzles. Each nozzle is mounted in a nozzle boss, and the nozzle bosses are disposed at rear sides of the head sections. The drilling fluid impacts the well bottom and then returns back up from both sides of the nozzle boss. The bit contacts the borehole wall at three points on a heel row of cutting elements of the cones, and the point of contact is on a leading side of each cone. When horizontal wells and hard formation wells are drilled, the roller cone bit has the following problems: quick lateral movement and strong impact result in deviation of the center of rotation of the bit from its geometric center and acceleration of wear and break of the cutting elements, and even lead to premature bearing failure; due to gravity, removal of drilling cuttings from the well bottom is poor, which also easily results in that the cone shell wears and cutting elements breakage or loss; the water jet orientation is unreasonable, and the cutting elements are not timely cooled accordingly, thereby accelerating the wear. Wear-resistant cutting elements are arranged above OD of the head sections (head OD) to resist lateral vibration, but they cannot adequately suppress severe lateral vibration as the cutting elements arrangement center on the OD of the head sections is usually on the axis of the head sections.

U.S. Pat. No. 6,227,314 (entitled "INCLINED LEG EARTH-BORING BIT") changes the conventional rear nozzle boss into a front nozzle boss, the upper portion of the head OD is offset circumferentially a distance relative to the lower portion, a gage point is formed on the upper portion of the head OD, the nozzle boss and the lower portion of the leg form a mud up-return channel, but the channel changes its direction on the upper portion of the leg, not helpful for smooth up-return of the mud.

U.S. Pat. No. 6,688,410 (entitled "Hydro-lifter rock bit with PDC inserts") cancels the cone gage point, but disposes the gage point on the upper portion of the head OD, the geometric centerline on the upper portion of the head OD is parallel to the centerline of the bit, and the geometric centerline on the lower portion is at an angle to the centerline of the bit. In this patent, the borehole diameter is formed by cutting action of the head OD, which can decrease drilling efficiency of the bit.

SUMMARY OF THE INVENTION

In one aspect, the present invention relates to a tricone rock bit for horizontal wells and hard formation wells, which can reduce lateral vibration of the cone rock bit in drilling of horizontal wells and hard formation wells, and has a better bottom hole cleaning effect, thereby further improving drilling efficiency and comprehensive effects of the cone rock bit, so as to solve shortcomings existing in the prior art.

The present invention provides a tricone rock bit for horizontal wells and hard formation wells, which includes three head sections and cones mounted at lower ends of the head sections. Upper portions of the three head sections are integrally connected to form a bit body, nozzle bosses are formed between the head sections on the bit body, and nozzles are mounted in orifices of the nozzle bosses. Upper rear sides of OD of the head sections (head OD) are provided with gauge cutting elements, to form a gauge surface on the upper portions of the head sections, a front side of the head sections is a ruled surface (in the present application, the ruled surface is such a surface that is formed with a straight line (the straight line may be called a generating line) moving and sweeping along an axis parallel to the straight line in a continuously gradual (without mutation) manner, which may be, for example, a plane, or a curved surface projected into a curve along the generating line, such as an arc-shaped surface), and deflects backward at an angle of $\alpha$ and deflects outward at an angle of $\beta$, where the value of $\alpha$ is 10°~50°, the value of $\beta$ is 0°~15°; the front side of the head sections can be obtained with a plane or a curved surface sequentially rotating at angles of $\alpha$ and $\beta$ around a horizontal axis X and a longitudinal axis Z of the bit body in an initial azimuth and then shifting, where the horizontal axis X and the longitudinal axis Z of the bit body intersect at point O; when the front side of the head sections is a plane, its initial azimuth is located in a plane XOZ defined by the horizontal axis X and the longitudinal axis Z, while when the front side of the head sections is a curved surface projected into a curve along the generating line, its initial azimuth is defined as the following azimuth where the generating line is parallel to the longitudinal axis Z, and the horizontal axis X extends to pass through two endpoints of the curve.

In one embodiment, a front side of the head OD is a plane, in its initial azimuth, the plane is located in the XOZ plane, and an ultimate position of the front side of the head sections is obtained as follows: the plane is first rotated around the X axis at the angle of $\alpha$, and then rotated around the Z axis at the angle of $\beta$, then the plane can be shifted and connected with other surfaces on the OD of the head sections (head OD), to ultimately form the front side of the head OD.

In one embodiment, a front side of the head sections is a part of a cylindrical surface, in its initial azimuth, a generating line of the cylindrical surface is parallel to the vertical axis Z, a projection of the cylindrical surface along the vertical axis Z is a section of an arc, the horizontal axis X extends to pass through two endpoints of the arc, and an ultimate position of the front side of the head sections is obtained as follows: the cylindrical surface is first rotated around the X axis at the angle of $\alpha$, and then rotated around the Z axis at the angle of $\beta$, then the cylindrical surface is shifted and connected with other surfaces on the OD of the head sections (head OD), to ultimately form the front side of the head OD.

In one embodiment, rotation around the X axis is rotation along a clockwise direction when being observed along the X axis but against a positive direction of the X axis, and rotation around the Z axis is rotation along a counterclockwise direction when being observed along the Z axis but against a positive direction of the Z axis.

In one embodiment, the value of the angle α declining backward is 20°~40°; further, the value of the angle α declining backward is 20°~30°, and the value of the angle β declining outward is 3°~10°.

In one embodiment, the upper rear sides of OD of the head sections (head OD) extend backward to a distance, and the nozzle boss is arranged in a leg portion with the upper rear sides of OD of the head sections (head OD) extending backward.

In one embodiment, an upper slope and a lower slope are formed on the rear side of the leg, and the two slopes and a front side of the following leg form a mud up-return channel declining backward.

In one embodiment, the shape of a radial section (that is, a section perpendicular to the generating line) of the front side of the head sections is a straight line, an arc, a parabola, or a hyperbola.

In one embodiment, a jet direction of the nozzle in the nozzle boss is toward a front side of the following cone and between a heel row of cutting elements and a middle row of cutting elements.

In one embodiment, 2-3 rows of gauge cutting elements are inlaid on the gauge surface on the rear sides of the upper portions of the OD of the head sections (head OD) or the leg portion extending backward, and 2-3 gauge cutting elements in each row are staggered at intervals; 2-3 rows of gauge cutting elements are further mounted on the OD of the head sections (head OD), and 4-8 gauge cutting elements in each row are staggered at intervals; tactical diameters of all the gauge cutting elements on the leg portion extending backward that the OD of the head sections (head OD) include are 0-2 mm less than the gage diameter, and the tactical diameters gradually decrease from bottom to up and from front to back; the gauge cutting elements are cemented carbide cutting elements or diamond composite cutting elements, and a crown shape of the gauge cutting elements is flat or spherical. The beneficial effects of the present invention are as follows: (1). a gage point is set on an upper portion of a rear side of the back of the leg (head OD), which enhances drilling stability of the bit and reduces lateral vibration, and the bit does not offset easily in drilling of horizontal wells, thereby increasing the effective life of the roller cone bit; (2). the front side of the head OD wholly declines backward and outward, to form a smooth mud up-return channel, and also form a lifting force for drilling cuttings at the bottom, which promotes the drilling cuttings to up return with the mud, makes the speed of the mud up-return rapid, and facilitates increasing of the drilling efficiency; (3). the jet direction of the nozzle is guided to a front side of the following cone, so that the drilling fluid could directly jet and flush the work face of the cutting elements, which enhances the bottom hole cleaning and cooling effects of the cutting elements. This type of bit achieves a good effect in actual use, and in sections of horizontal wells and hard formation wells, compared with the conventional bit, the drilling footage is increased by 40% on average, and the average service life is doubled.

DETAILED DESCRIPTION OF THE INVENTION

The description will be made as to the embodiments of the present invention in conjunction with the accompanying drawings.

Figure 1:
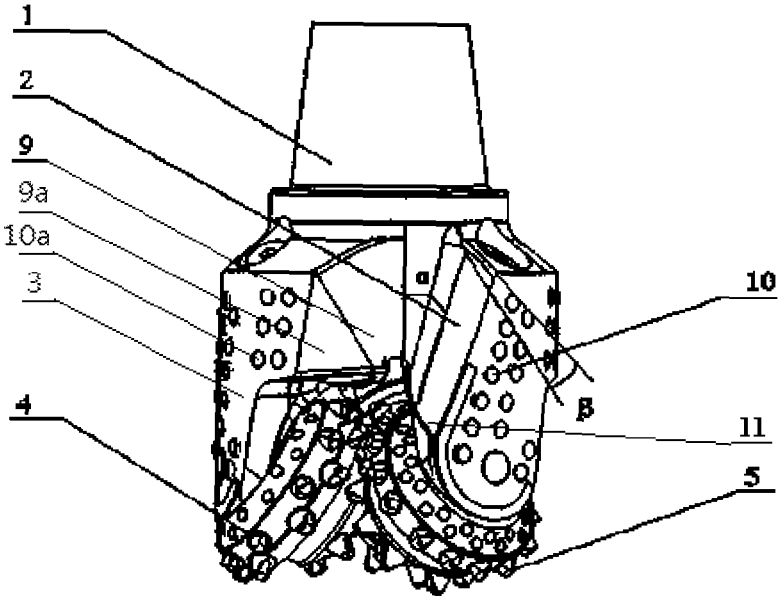
FIG. 1 is a front view of a bit according to one embodiment of the present invention.
Figure 2:
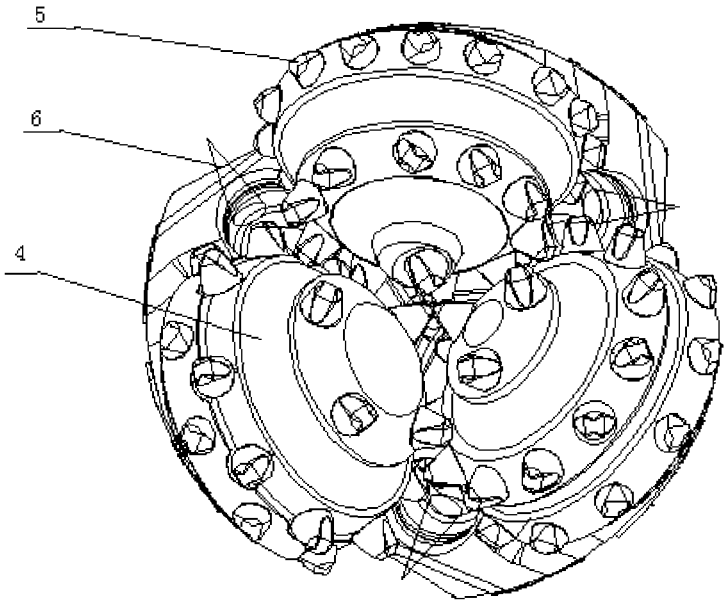
FIG. 2 is a bottom view of a bit according to one embodiment of the present invention.
Figure 3:
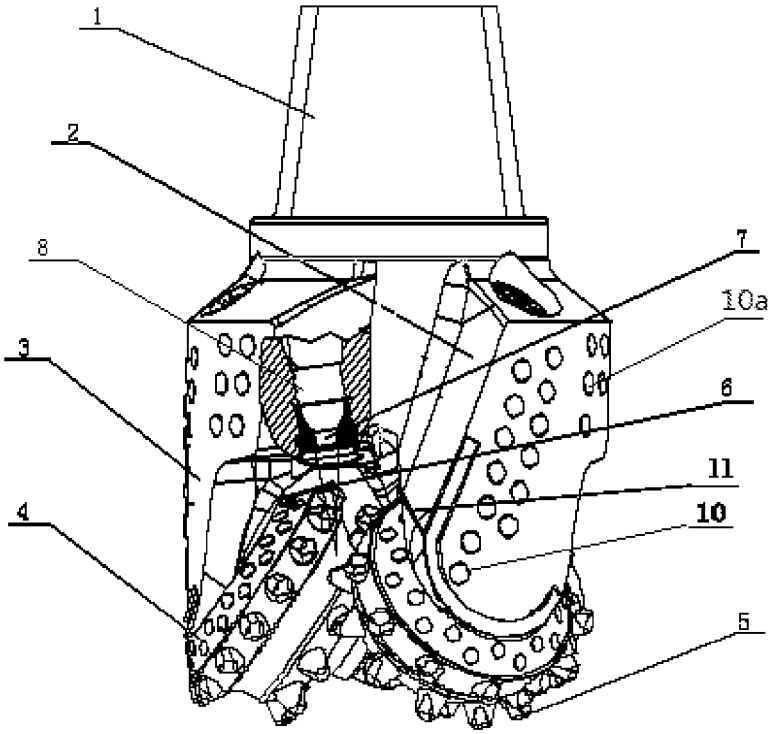
FIG. 3 is a front view of a partial sectional view of a bit with a nozzle boss according to one embodiment of the present invention.

The first embodiment of the tricone rock bit is shown in FIGS. 1-3, which includes three head sections 3 and cones 4 mounted at lower ends of the head sections. Upper portions of the three head sections are integrally connected to form a bit body by welding, an upper portion of the bit body is provided with taper threads 1, for connecting a drilling string; upper rear sides of the head sections extend backward to a distance, to form a head portion extending backward. Gauge cutting elements 10*a* are mounted on a portion of the head sections extending backward. The gauge cutting elements 10*a* are inlaid on the head sections, 2-3 rows may be arranged at front and rear, 2-3 gauge cutting elements in each row may be staggered at intervals, the gauge cutting elements are diamond composite cutting elements or cemented carbide cutting elements, to form a gauge surface on the upper portions of the head sections 3. 2-3 rows of gauge cutting elements 10 may be further inlaid on the head sections, 4-8 gauge cutting elements in each row may be staggered at intervals; tactical diameters of all the gauge cutting elements on the head sections are 0-1 mm less than a gage diameter, and the tactical diameters gradually decrease from bottom to up and from front to back. After the gauge cutting elements 10 and 10*a* are inlaid on the gauge surface on the upper portions of the head sections 3, the diameter of this portion is 1 mm less than the gage diameter of the roller cone bit, and lateral stability of the bit is enhanced.

A front lateral side of the head sections 3 is a ruled surface, the ruled surface is at an angle of α (declining backward) to an axis of the bit, and is at an angle of β (declining outward) to a horizontal reference axis (X axis), where the value of α is 10°~50°, for example, 20°~30°, the value of β is 0°~15°, for example, 8°~10°. In the present application, the ruled surface is such a surface that is formed with a straight line (the straight line may be called a generating line) moving and sweeping along an axis parallel to the straight line in a continuously graded (i.e., without a sudden change) manner, which may be, for example, a plane, where a trace of the sweeping is a straight line 11, or a curved surface projected into a curve along the generating line, such as an arc-shaped surface.

An upper slope 9 and a lower slope 9*a* are formed on the rear side of the head section, and the two upper and lower slopes 9 and 9*a* and a front lateral side of the following adjacent head section form a mud up-return channel wide at the bottom and narrow at the top and declining backward, which forms a great lifting force for drilling cuttings at the bottom, and promotes the drilling cuttings to up return with the mud. A nozzle boss 8 is disposed in a head portion with the upper rear sides of the head sections of the bit body extending backward, a fluid course is disposed in the bit body and communicates with an orifice of the nozzle boss 8. A nozzle 7 is mounted in the orifice of the nozzle boss 8, where a jet direction 6 of the nozzle 7 is toward a front lateral side of the following cone and between an outer row of cutting elements and a middle row of cutting elements, a minimum distance between a nozzle potential core of jet and the following cone cutting elements is 0, so that cutting elements 5 are effectively cooled when entering the work face and during operation.

Figure 4:
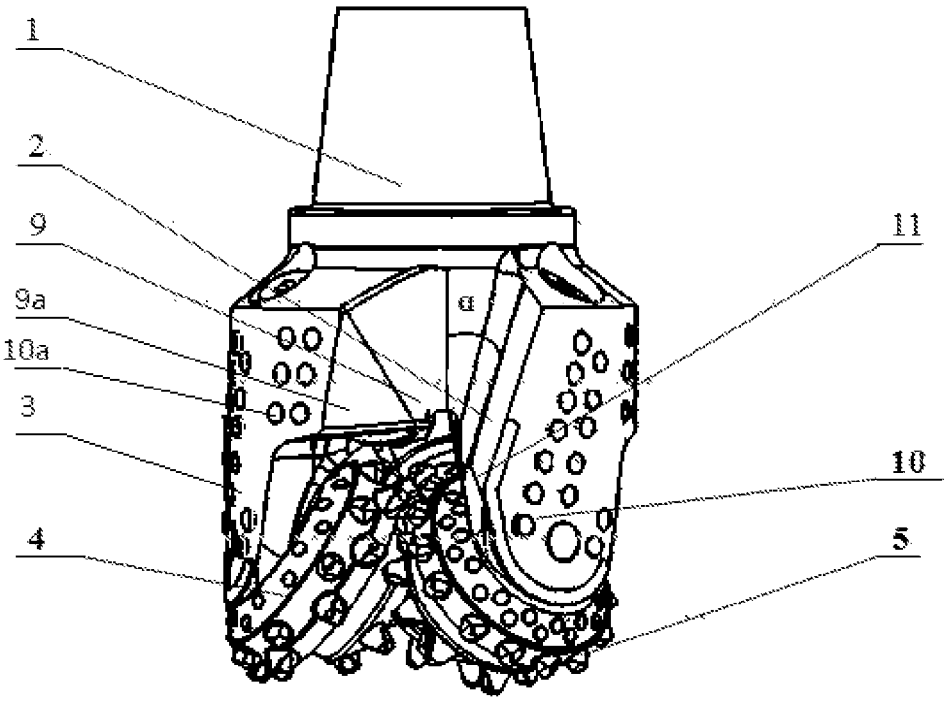
FIG. 4 is a front view of a bit according to another embodiment of the present invention.

The second embodiment of the present invention is shown in FIG. 4, and is different from the previous embodiment in that a front side 2 of the head sections is not inclined outward, and an angle β formed between the front side 2 and the central plane of the bit is equal to 0.

Figure 5:
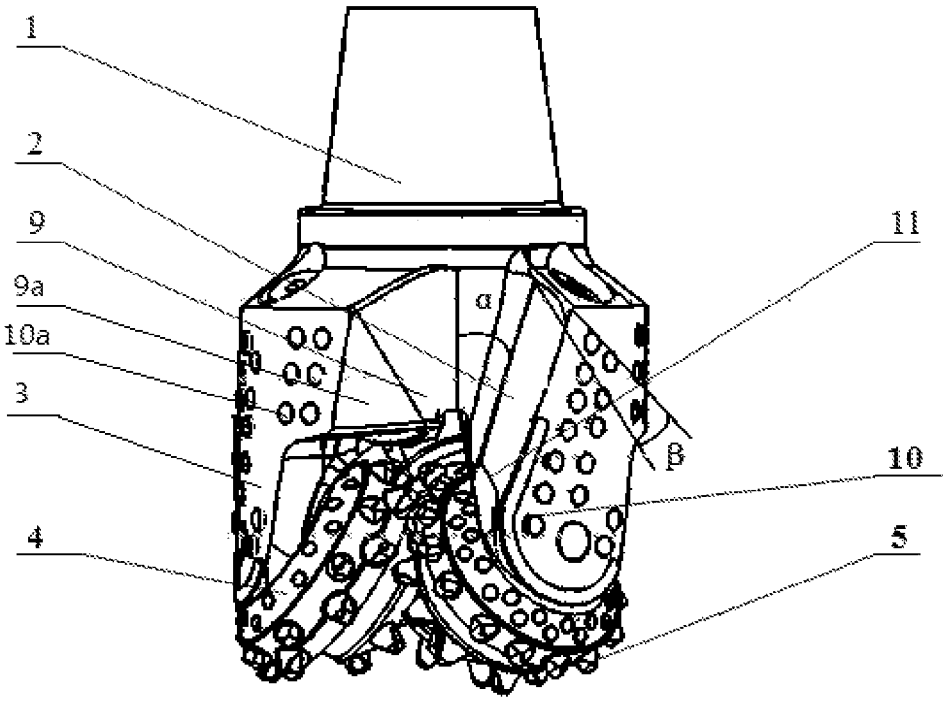
FIG. 5 is a front view of a bit according to a third embodiment of the present invention.

The third embodiment of the present invention is shown in FIG. 5, and is different from the first embodiment in that the shape of a radial surface (that is, a section perpendicular to the generating line) of a front side 2 of the head sections is an inwardly concave arc, to form a front side of the leg inclined outwards and being an inwardly concave arc surface.

Alternatively, the shape of the radial surface (that is, a section perpendicular to the generating line) of the front side of the head sections is a parabola or a hyperbola.

In one embodiment, the front side of the head sections can be obtained by sequentially rotating at angles of α and β around a horizontal axis X and a longitudinal axis Z of the bit body in an initial azimuth and then shifting, where the horizontal axis X and the longitudinal axis Z of the bit body intersect at point O; when the front side of the head sections is a plane, its initial azimuth is located in a plane XOZ defined by the horizontal axis X and the longitudinal axis Z, while when the front side of the head sections is a curved surface projected into a curve along the generating line, its initial azimuth is defined as the following azimuth where the generating line is parallel to the longitudinal axis Z, and the horizontal axis X extends to pass through two endpoints of the curve.

In one embodiment, when a front lateral side of the head sections is a plane, in the initial azimuth, the plane is located in the XOZ plane, and an ultimate position of the front lateral side of the head sections is obtained as follows: the plane is first rotated around the horizontal axis X at the angle of α, and then rotated around the longitudinal axis Z at the angle of β, then the plane can be shifted and connected with other surfaces on head sections, to ultimately form the front lateral side of the head sections.

According to another aspect of the present invention, when a front lateral side of the head sections is a part of a cylindrical surface, in the initial azimuth, the generating line of the cylindrical surface is parallel to the longitudinal axis Z, a projection of the cylindrical surface along the longitudinal axis Z is a section of an arc, the horizontal axis X extends to pass through two endpoints of the arc, and an ultimate position of the cylindrical surface of the head sections is obtained as follows: the cylindrical surface is first rotated around the horizontal axis X at the angle of α, and then rotated around the longitudinal axis Z at the angle of β, then the cylindrical surface can be shifted and connected with other surfaces on the head sections, to ultimately form the front lateral side of the head section.

Figure 6A:
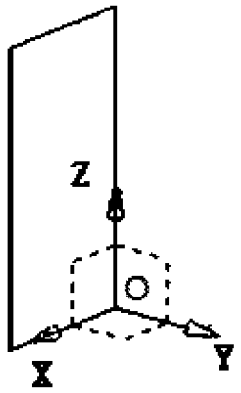
FIGS. 6*a*-6*c* are schematic views showing how to obtain an ultimate azimuth from an initial azimuth when a front side of the head OD is a plane.
Figure 6B:
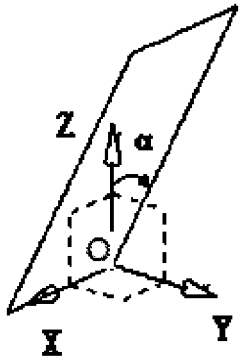
Figure 6C:
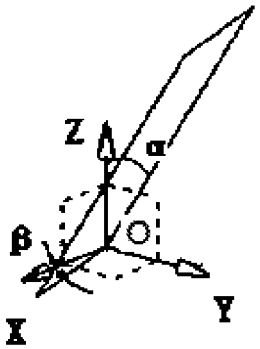

FIGS. 6*a*-6*c* exemplarily show a process of forming an ultimate azimuth from an initial azimuth when a front lateral side of the head sections is a plane.

As shown in FIGS. 6*a*-6*c*, the front lateral side of the head sections is a plane, in the initial azimuth, the plane is located in the XOZ plane. For ease of description without limitations, vertical edges of a rectangle shown to represent a plane coincide with the longitudinal axis Z or are parallel to the longitudinal axis Z, and horizontal edges of the rectangle coincide with the horizontal axis X (refer to FIG. 6*a*). In this way, the plane is first rotated around the horizontal axis X (for example, rotated clockwise when being observed along the horizontal axis X but against a positive direction of the horizontal axis X) at the angle of a (refer to FIG. 6*b*), rotated around the longitudinal axis Z (for example, rotated counterclockwise when being observed along the longitudinal axis Z but against a positive direction of the longitudinal axis Z) at the angle of β (refer to FIG. 6*c*), and then is shifted and connected with other surfaces on the head sections, and finally the front lateral side of the head sections is formed through cutting. In other words, the front lateral side of the head sections can be obtained with a plane sequentially rotating at angles of α and β around a horizontal axis X and a longitudinal axis Z of the bit body from an initial azimuth and then shifting.

Figure 7A:
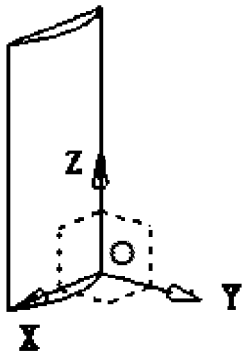
FIGS. 7*a*-7*c* are schematic views showing how to obtain an ultimate azimuth from an initial azimuth when the front side of the head OD is a part of a cylindrical surface.
Figure 7B:
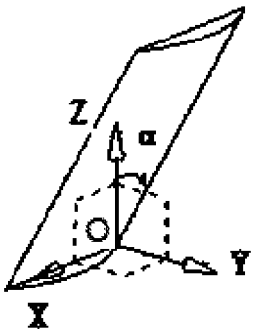
Figure 7C:
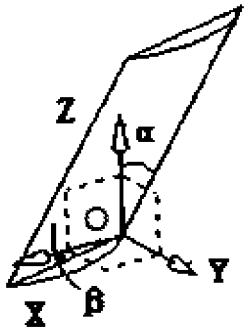

FIGS. 7*a*-7*c* exemplarily show a process of forming an ultimate azimuth from an initial azimuth when a front lateral side of the head sections is a part of a cylindrical surface. The front lateral side of the head sections is a curved surface of a part of a cylindrical surface, in its initial azimuth, as shown in FIG. 7*a*, the generating line of the cylindrical surface is parallel to the longitudinal axis Z, and the horizontal axis X extends to pass through two endpoints of the arc of the cylindrical surface projected along the longitudinal axis Z. In this way, the cylindrical surface is first rotated around the horizontal axis X (for example, rotated clockwise when being observed along the horizontal axis X but against a positive direction of the horizontal axis X) at the angle of α (refer to FIG. 7*b*), and then is rotated around the longitudinal axis Z (for example, rotated counterclockwise when being observed along the longitudinal axis Z but against a positive direction of the longitudinal axis Z) at the angle of β(refer to FIG. 7*c*), then the cylindrical surface is shifted and connected with other surfaces on the head sections, and finally the front lateral side of the head sections is formed through cutting. In other words, the front lateral side of the head sections can be obtained with a cylindrical surface sequentially rotating at angles of α and β around a horizontal axis X and a longitudinal axis Z of the bit body from an initial azimuth and then shifting.

What is claimed is:

1. A tricone rock bit for horizontal wells and hard formation wells, comprising: three head sections and cones mounted at lower ends of the three head sections, wherein upper portions of the three head sections are integrally connected to form a bit body; nozzle bosses are arranged between the head sections on the bit body, and nozzles are mounted in orifices of the nozzle bosses; upper rear sides of the head sections are provided with gauge cutting elements to form a gauge surface on the upper portions of the head sections; a front lateral side of the head sections is a ruled surface and declines backward at an angle of α and declines outward at an angle of β, the value of a being 10°~50°, and the value of β being 3°~10°; the ruled surface is a surface that is formed with a straight line moving and sweeping along an axis parallel to the straight line in a continuously graded manner, and the ruled surface is a plane or a curved surface projected into a curve along a generating line that is coincident with the straight line; the front lateral side of the head sections is defined by sequentially rotating the plane or the curved surface at the angle of α around a horizontal axis X of the bit body and at the angle of β around a longitudinal axis Z of the bit body from an initial azimuth and then shifting, the horizontal axis X and the longitudinal axis Z of the bit body intersecting at point O; wherein when the front lateral side of the head sections is the plane, the initial azimuth is located in a plane XOZ defined by the horizontal axis X, the point O and the longitudinal axis Z, while when the front lateral side of the head sections is the curved surface projected into the curve along the generating line, the initial azimuth is defined such that the generating line is parallel to the longitudinal axis Z, and the horizontal axis X extends to pass through two endpoints of the curve.

2. The tricone rock bit for horizontal wells and hard formation wells according to claim 1, wherein the front lateral side of the head sections is the plane, in the initial azimuth, the plane is located in the XOZ plane, and an ultimate position of the front lateral side of the head sections is obtained as follows: the plane is first rotated around the horizontal axis X at the angle of $\alpha$, and then rotated around the longitudinal axis Z at the angle of $\beta$, then the plane is shifted and connected with other surfaces on the head sections, to ultimately form the front lateral side of the head sections.

3. The tricone rock bit for horizontal wells and hard formation wells according to claim 2, wherein the rotation around the horizontal axis X is rotation along a clockwise direction observed along the horizontal axis X but against a positive direction of the horizontal axis X, and the rotation around the longitudinal axis Z is rotation along a counterclockwise direction observed along the longitudinal axis Z but against a positive direction of the longitudinal axis Z.

4. The tricone rock bit for horizontal wells and hard formation wells according to claim 1, wherein the front lateral side of the head sections is a part of a cylindrical surface, in the initial azimuth, the generating line of the cylindrical surface is parallel to the longitudinal axis Z, a projection of the cylindrical surface along the longitudinal axis Z is a section of arc, the horizontal axis X extends to pass through two endpoints of the arc, and an ultimate position of the front lateral side of the head sections is obtained as follows: the cylindrical surface is first rotated around the horizontal axis X at the angle of $\alpha$, and then rotated around the longitudinal axis Z at the angle of $\beta$, then the cylindrical surface is shifted and connected with other surfaces on the head sections, to ultimately form the front lateral side of the head sections.

5. The tricone rock bit for horizontal wells and hard formation wells according to claim 1, wherein the value of the angle $\alpha$ declining backward is 20°~40°.

6. The tricone rock bit for horizontal wells and hard formation wells according to claim 5, wherein the value of the angle $\alpha$ declining backward is 20°~30°.

7. The tricone rock bit for horizontal wells and hard formation wells according to claim 1, wherein the upper rear sides of the head sections extend backward to a distance, and the nozzle boss is arranged in a portion of head section with the upper rear sides of the head sections (head OD) extending backward.

8. The tricone rock bit for horizontal wells and hard formation wells according to claim 7, wherein an upper slope and a lower slope are formed on the rear side of each head section, and the upper and lower slopes of the head section and a front lateral side of the following adi acent head section forms a mud up-return channel declining backward.

9. The tricone rock bit for horizontal wells and hard formation wells according to claim 1, wherein a cross-sectional shape, perpendicular to the generating line, of the front lateral side of the head sections is a straight line, an arc, a parabola, or a hyperbola.

10. The tricone rock bit for horizontal wells and hard formation wells according to claim 1, wherein a jet direction of the nozzle in each nozzle boss is toward a front lateral side of the following adjacent cone and between a heel row of the cutting elements and a middle row of the cutting elements.

11. The tricone rock bit for horizontal wells and hard formation wells according to claim 10, wherein a minimum distance between a nozzle potential core of jet and the following adjacent cone cutting elements is 0.

12. The tricone rock bit for horizontal wells and hard formation wells according to claim 1, wherein 2-3 rows of the gauge cutting elements are mounted on the gauge surface on the rear sides of the upper portions of the head sections or a backward extending head portion of the head sections, each row has 2-3 gauge cutting elements staggered at intervals.

13. The tricone rock bit for horizontal wells and hard formation wells according to claim 12, wherein 2-3 rows of the gauge cutting elements are further inlaid on lower portions of the head sections, and each row has 4-8 gauge cutting elements staggered at intervals.

14. The tricone rock bit for horizontal wells and hard formation wells according to claim 13, wherein tactical diameters of all the gauge cutting elements on the backward extending head portion of the head sections are less than 0-2 mm of a gage diameter, and the tactical diameters gradually decrease from bottom to up and from front to back of the gauge cutting elements.

15. The tricone rock bit for horizontal wells and hard formation wells according to claim 13, wherein the gauge cutting elements are cemented carbide cutting elements or diamond composite cutting elements, and a top portion of each gauge cutting element is flat or spherical.

* * * * *